US006849565B1

(12) United States Patent
Gardner et al.

(10) Patent No.: US 6,849,565 B1
(45) Date of Patent: Feb. 1, 2005

(54) CARPET CONSTRUCTION AND CARPET BACKINGS FOR SAME

(75) Inventors: Hugh C. Gardner, Roswell, GA (US); Jack F. Godfrey, Cohutta, GA (US); Kenneth R. Jones, Rossville, GA (US); Larry M. Bailey, Decatur, GA (US); Edward Barkis, Marietta, GA (US); Eric J. Bryant, Kennesaw, GA (US); Gregory P. Shelnutt, Douglasville, GA (US)

(73) Assignee: BP Corporation North America Inc., Warrenville, IL (US)

( * ) Notice: Subject to any disclaimer, the term of this patent is extended or adjusted under 35 U.S.C. 154(b) by 0 days.

(21) Appl. No.: 09/634,474

(22) Filed: Aug. 8, 2000

Related U.S. Application Data

(63) Continuation of application No. 08/913,435, filed as application No. PCT/US96/03485 on Mar. 15, 1996, now abandoned, and a continuation-in-part of application No. 08/406,174, filed on Mar. 17, 1995, now abandoned.

(51) Int. Cl.[7] ..... B32B 5/06; B32B 5/08; B32B 5/26; B32B 7/08; B32B 7/10

(52) U.S. Cl. ..... 442/35; 442/2; 442/268; 442/270; 442/275; 442/277; 428/95

(58) Field of Search ..... 428/95, 97; 442/2, 442/32, 35, 268, 270, 275, 277

(56) References Cited

U.S. PATENT DOCUMENTS

| | | | | |
|---|---|---|---|---|
| 3,551,231 | A | | 12/1970 | Smedberg |
| 3,583,936 | A | | 6/1971 | Stahl |
| 3,605,666 | A | | 9/1971 | Kimmel et al. |
| 3,684,600 | A | | 8/1972 | Smedberg |
| 3,817,817 | A | | 6/1974 | Pickens, Jr. et al. |
| 3,922,454 | A | * | 11/1975 | Roecker ..... 428/95 |
| 4,053,668 | A | * | 10/1977 | Kimmel et al. ..... 112/410 |
| 4,069,361 | A | | 1/1978 | Kumar |
| 4,123,577 | A | | 10/1978 | Port et al. |
| 4,138,519 | A | * | 2/1979 | Mitchell ..... 428/95 |
| 4,140,071 | A | * | 2/1979 | Gee et al. ..... 112/475.23 |
| 4,242,394 | A | | 12/1980 | Leib et al. |
| 4,439,476 | A | | 3/1984 | Guild |
| 4,482,595 | A | * | 11/1984 | Fujishita et al. ..... 139/420 A |
| 4,939,036 | A | * | 7/1990 | Reith ..... 428/349 |
| 5,030,497 | A | * | 7/1991 | Claessen ..... 428/95 |
| 5,173,356 | A | | 12/1992 | Eaton et al. |
| 5,240,530 | A | | 8/1993 | Fink |
| 5,380,574 | A | * | 1/1995 | Katoh et al. ..... 428/92 |
| 5,532,035 | A | * | 7/1996 | Corbin et al. ..... 28/107 |
| 5,630,896 | A | * | 5/1997 | Corbin et al. ..... 156/148 |

FOREIGN PATENT DOCUMENTS

| | | |
|---|---|---|
| CA | 1185844 | 4/1985 |
| EP | 0568916 A1 | 11/1993 |

* cited by examiner

*Primary Examiner*—Cheryl A. Juska
(74) *Attorney, Agent, or Firm*—Stephen L. Hensley

(57) ABSTRACT

Carpet backings and use thereof in tufted carpets with good tuft bind and fuzz resistance and free of inorganic and latex materials are disclosed. Backings suitable as tuftable primary backings or as secondary backings have a nonwoven fabric with thermoplastic filaments and a thermoplastic supporting fabric operatively attached as by needling, thermal calendaring or point bonding.

9 Claims, No Drawings

CARPET CONSTRUCTION AND CARPET BACKINGS FOR SAME

This is a continuation of application No. 08/913,435, filed Dec. 11, 1997, now abandoned, which is the National Phase (35, USC 371) of PCT/US96/03485, filed March 15, 1996, and is a continuation-in-part of US08/406,174, filed Mar. 17, 1995, now abandoned.

FIELD OF THE INVENTION

This invention relates to tufted carpets which are substantially free of non-thermoplastic components. The invention also relates to new primary and secondary carpet backings suitable for the manufacture of such carpets comprising at least two thermoplastic fabric layers, in which one of the layers is made from a meltable thermoplastic adhesive. In addition, the invention also relates to a process for the manufacture of such carpets in which the adhesive for binding the face yarns of the tufted carpet to the primary backing, and also for binding the secondary backing to the primary backing, is conveniently provided in the form of a fabric made from a meltable thermoplastic adhesive.

BACKGROUND OF THE INVENTION

Manufacture of tufted carpets normally involves three basic operations: tufting a primary backing; washing, dyeing and drying the tufted backing; and then subjecting the same to a finishing operation.

Tufting usually is accomplished by inserting reciprocating needles threaded with yarn through the primary backing to form tufts or loops of yarn. Loopers or hooks, typically working in timed relationship with the needles, are located such that the loopers are positioned just above the needle eye when the needles are at an extreme point in their stroke through the backing fabric. When the needles reach that point, yarn is picked up from the needles by the loopers and held briefly. Loops or tufts of yarn result from the passage of the needles back through the primary backing. This process typically is repeated as the loops move away from the loopers due to advancement of the backing through the needling apparatus. If desired, the loops can be cut to form a cut pile, for example, by using a looper and knife combination in the tufting process. Alternatively, the loops can remain uncut.

In 1992, the total production of carpet in the United States was 1.3 billion square yards. Of that amount, 95% was made by tufting, with the remainder made by weaving. Major face yarn types currently used in the manufacture of tufted carpets are nylon yarns, normally composed of poly(epislon-caprolactam) or poly(hexamethylene adipamide), also known as nylon-6 and nylon 6,6, respectively; propylene polymer yarns, typically composed of propylene homopolymer; and polyester yarns, normally composed of polyethylene terephthalate. In 1993, according to *Carpet & Rug Industry*, October, 1993, page 6, the total United States carpet face yarn market was projected to be about 2.7 billion pounds. Nylon yarns accounted for about 68% of this market, polypropylene yarns for about 19%, and polyester yarns accounted for about 10%. Wool, cotton, acrylic, and other yarns accounted for about 3% of the total. Accordingly, it will be appreciated that the vast majority of carpets manufactured in the United States are tufted carpets, and that of all tufted carpets, the vast majority are manufactured with thermoplastic face yarns.

Primary backings for tufted carpets are typically woven fabrics made of synthetic yarns, although nonwoven fabrics can also be used. The most common synthetic material used in primary backings is polypropylene, although polyesters also find use in the industry. Again, it will be appreciated that the vast majority of backings for tufted carpets are manufactured from thermoplastics.

The carpet finishing operation typically involves application of a latex binder (typically a filled thermoset resin emulsion) and a secondary backing. According to "Carpet Laminating", *Journal of Coated Fabrics*, Volume 19, July 1989, pp. 35–52, the material most typically used for carpet backcoating is styrene butadiene latex (SBR), usually a carboxylated SBR. The overwhelming majority of tufted carpet today is finished by laminating a secondary backing to the tufted primary with a latex.

More particularly, finishing is typically done in the following manner. The backside (i.e., the non-pile side) of a tufted primary backing is coated with a mixture containing a latex (100 parts), ground limestone or other inert particulate filler (300–500 parts), and processing aids such as surfactants, penetrants, defoamers, dispersants, chelating agents, stabilizers, and thickeners (1–3 parts). A woven polypropylene secondary backing is then attached to the backcoated tufted primary backing by passing the structure through a set of rolls, typically at the entrance to a large circulating air oven. The carpet is held taut on a tenter frame as it passes through the oven, setting the latex and driving off the water. The finished carpet then exits the oven, cools slightly by passing over a series of rolls, and is then inspected and taken up on a roll. While there are several variations on this basic process, such as the use of a "double-pan" to apply the latex binder mixture in two applications (the mixture in each application having a different viscosity), regardless of the method of application, the total latex binder weight is typically about 25–30 ounces per square yard. A typical line speed through the drying oven is 75 feet per minute.

Latex binders dominate the carpet industry because of their ability to provide good performance properties at low cost. Among the properties provided by the latex binders to the final carpet product are high tuft bind (anchoring of the yarn bundles), fuzz resistance (resistance of the fibers in the yarn bundles to being pulled out), and adhesion to the secondary backing (sometimes referred to as delamination or peel strength). These properties can be provided at a raw material cost for the latex binder mixture of roughly one cent per ounce per square yard, or about 25 cents per square yard for a typical carpet.

Problems Facing The Carpet Industry

Because of the combination of economics and physical properties, the above-described method for making carpet is used in 80–90% of all carpet made in the United States. However, this carpet-making method has both process and environmental disadvantages. On the process side, the conventional carpet-making method has the disadvantage of requiring a drying step to set the latex. The drying step increases the cost of the carpet and limits production speed. Moreover, the ovens used to dry the latex are quite expensive, costing several hundred thousand to in excess of a million dollars. Not only are the ovens capital intensive pieces of equipment, but they also consume energy in operation. The above-described method for making carpets also requires expensive applicators and other associated equipment for the handling, storage and application of the latex binder to the tufted primary backing. Depending on the particular process employed, additional equipment may be required for the application of the latex to the secondary backing as well. The operation and maintenance of such equipment is labor intensive and costly.

The environmental disadvantages associated with the use of the traditional latex are generally two-fold. Firstly, the use of such hinders the recyclability of used carpet and even scrap product which is generated in the manufacturing process, such as selvage and off-spec carpet because the latex cannot generally be remelted; the latex causes sticking in molds and other recycling apparatus; the latex releases foul odors upon being heated; and the latex requires excessive mechanical energy be applied to recycle product containing the latex. With the decreasing availability and increasing cost of suitable landfills for such mill scrap, the carpet industry has experienced a need for finding other alternative uses for its mill scrap.

Indeed, the issue of recyclability with respect to mill scrap alone is a serious problem notwithstanding the fact that the face yarns and backings typically used in a carpet are made from all-thermoplastic materials. Once these components are contaminated with the filled latex (which includes a very significant component of inorganic filler e.g., calcium carbonate), they are difficult to recycle economically and because of the aforementioned technical problems. Moreover, while the carpet industry has done an admirable job of streamlining its operations to reduce waste and recycle materials to the extent possible, it is nevertheless a fact of manufacturing life that even the more efficient carpet mills generate scrap which is equivalent to roughly 0.5–1% of their commercial output. In the United States, this corresponds to somewhere on the order of 10 million square yards or 30 to 40 million pounds, annually, of mill scrap. When the problem of disposing of used carpet is factored into the recyclability issue, it can be seen that this is a major challenge for the carpet industry.

The other environmental concern relating to the use of latex compositions relates to speculation that the compositions may generate certain volatile organic compounds (VOCs). These VOCs may contribute to the so-called "sick building syndrome". See "Is carpet hazardous to our health?", *Carpet & Rug Industry*, October 1990. VOC emissions during carpet manufacturing have also led some mills to add special air handling and ventilation equipment, again contributing to the expense of carpet manufacture.

An additional disadvantage of the traditional latex to the manufacture of carpets is weight. A latex composition is typically extended by mixing into it large amounts of inorganic materials, particularly ground limestone. This increases the weight of the carpet significantly. In the transportation of carpets from the mills to their distribution centers, to retail locations, or in export, the transportation cost is typically based on weight. Accordingly, a reduction in the weight of carpet is highly desired. Moreover, the high level of inorganic filler not only contributes to the weight of the carpet, but also results in a stiff hand which may be a disadvantage in certain applications such as recreational vehicle and conversion van applications in which the carpet must conform to the contours of the vehicle's floor.

Accordingly, there has been a long felt need in the industry to find a low-cost, economic replacement for the latexes traditionally used in carpet construction, while nevertheless providing the desirable physical properties to the final carpet afforded by such latexes. Accordingly, for many years carpet manufacturers have been attempting to develop a new approach for the preparation of tufted carpets that eliminates or at least reduces the amount of latex used.

The Prior Art

Efforts to replace traditional latex compositions in tufted carpet construction can be described as falling into one of two general classes. In one class, molten adhesives have been applied in place of the latex composition. In the other class, the adhesive binder material has been provided in solid form, for example, as a powder or as a meltable fiber intermingled with the backing, and then subsequently melted and fused in a heating step.

One typical approach involving the application of the adhesive binder in molten form calls for the use of hot-melt adhesive. Application of a hot-melt adhesive is generally accomplished by passing the bottom surface of the tufted primary backing over an applicator roll positioned in a reservoir containing the hot-melt composition in a molten state. A doctor blade is ordinarily employed to control the amount of adhesive which is transferred from the application roll to the bottom surface of the structure. After application of the hot-melt composition to the bottom surface of the tufted primary, and prior to cooling, the secondary backing, if desired, is brought into contact with the bottom surface, and the resulting structure is then passed through heated nip rolls and subsequently cooled. By use of hot-melt adhesives, the necessity of drying the composition after application is eliminated. Further, when a secondary backing material is desired, it can be applied directly after the hot-melt composition is applied.

A number of hot-melt adhesives and processes using the hot-melt adhesive have been proposed for use in carpet lamination. For example, U.S. Pat. No. 3,551,231, issued Dec. 29, 1970 to Smedberg, U.S. Pat. No. 3,583,936, issued Jun. 8, 1971 to Stahl, and U.S. Pat. No. 3,684,600, issued Aug. 15, 1972 to Smedberg, each discloses the use of certain hot-melt adhesives for tufted carpet lamination. Thermoplastic resins are identified in each patent as useful components in the hot-melt adhesive composition. Hot melt adhesives have not proven to be a cost-effective solution to the carpet industry's needs, however, because of their cost, the generally high application rate required, and in some instances because the hot-melt adhesive itself presents some of the same environmental issues present with the use of latex.

Another approach involving the application of a molten adhesive to the tufted primary is extrusion coating or laminating. See, e.g., British Patent No. 971,958. In this process, an extruded sheet of molten binder material, which may be a thermoplastic polyolefin polymer, is applied to the back of the tufted primary backing. The extruded sheet is obtained by feeding a stock material to an extruder and extruding the stock material at relatively high temperatures to form a thin sheet through a die at a temperature sufficiently high to integrally fuse the extruded sheet to the tufted primary backing and, if desired, to a secondary backing. A recent example of the extrusion coating/extrusion laminating approach is U.S. Pat. No. 5,240,530, issued Aug. 31, 1993, to Fink. However, extrusion coating and extrusion laminating have not achieved wide spread acceptance in the industry for several reasons, including the high capital costs and technical challenges associated with installing and operating a wide-width (12 feet or greater) extrusion coater, the high application rates and relatively slow line speeds which can be achieved, and the high percentage of waste which results when a style change is introduced in the manufacturing operation. With respect to this later point, for example, it is not uncommon for a single carpet manufacturing operating to produce multiple grades and weights of carpets; each type of carpet may require a different amount of adhesive. Changing the application rate of the adhesive being delivered by an extruder cannot easily be achieved "on the fly," nor can a uniform appropriate application rate be maintained upon start-up without experiencing some waste.

In the other class of prior art, the adhesive binder material is provided in a solid form and then subsequently melted and fused in a heating step. One such approach is disclosed in commonly assigned Reith, U.S. Pat. No. 4,844,765, issued Jul. 4, 1989. Reith discloses providing the adhesive in the form of a film, preferably a composite film of two different viscosity adhesive compositions. While Reith addresses some of the problems of the industry, it suffers from several drawbacks. For example, as shown in Reith's examples, the adhesive composition is applied at a combined weight of approximately 1 pound per square yard in order to achieve FHA (Federal Housing Authority) minimum specifications for delamination strength and tuft bind. Further, Reith provides two separate films of different viscosities (or a composite made from two different films) in order to achieve acceptable carpet properties and to improve upon the results obtained when single films were used. Handling of the adhesive films also required the use of expensive release paper separators. These factors all contribute to the high cost of the Reith approach which has not found any commercial application in the marketplace.

Another approach in this same category is disclosed in U.S. Pat. No. 4,439,476, issued Mar. 27, 1984, to Guild. Guild supplies the adhesive material in the form of a low melting point polyamide staple fiber. In particular, Guild apparently first distributes the loose staple fiber on a primary backing and then needles the staple fibers into and through the primary backing. Guild states that upon melting the staple fibers, the tufts of the carpet are locked into the primary backing (although no numerical tuft bind data are provided). Guild is silent on the subject of the fuzz resistance of carpets produced according to his method and does not teach the use of pressure in carpet manufacturing. Further, Guild does not teach or suggest the importance of providing an adhesive coating on the bottom of, as opposed to underneath, the tuft stitches. Nevertheless, Guild does offer an approach which eliminates some of the problems in the art, such as the use of latex and the need for a drying operation. The disadvantages of Guild's approach, however, are at least three-fold. First, Guild does not appear to provide a carpet having fuzz resistance. Secondly, the low melting polyamide fiber taught and preferred by Guild is very expensive, costing approximately $8.50 per pound. Thirdly, Guild requires distributing the staple fibers onto the primary backing and then needling the fibers through the primary. Indeed, Guild repeatedly references the necessity for needling the meltable fibers so they extend continuously through the primary backing so as to form fibrous layers on each side of the primary backing. The needling operation, of course, adds further cost to the carpet. To the best of Applicants' knowledge, no carpet has ever been commercially produced or available using the Guild approach.

Yet another approach has been disclosed by Hoechst Celanese Corporation of Salisbury, N.C., in a paper entitled "All-Polyester Carpet System: Environmental and Performance Aspects", presented by L. G. Stockman, et al. at the International Durable Needlepunch Conference on Apr. 20, 1994 (previously summarized in "The Carpet Recycling Newsletter") Volume 93, No. 7 (September 1993). See also European Pat. Appl. 0 568 916 A1, published Nov. 10, 1993. According to this report, carpet may be constructed using a tufted polyester felt primary backing together with a polyester secondary backing, each backing containing a certain percentage of hetero-filled fiber with a low-melt sheath (binder fibers) intimately mixed with non-binder fibers which comprise the carpet backings. The backings are then needled together and heat treated. This approach is certainly a positive step in the direction of providing the market with a recyclable all-polyester carpet, but the physical properties disclosed for the carpets made using its approach are modest; none had a tuft bind in excess of 5.7 pounds and the fuzz resistance of a loop pile carpet made by this method is open to speculation. Moreover, and perhaps most significantly, this approach would require the installation of fiber blending equipment, and also needling lines in carpet manufacturing mills. This would be a substantial investment for the carpet industry, one it is unlikely to make. Moreover, this approach calls for the use of exotic bi-component fibers; these are expensive. In addition, this approach uses a nonwoven primary backing, and a nonwoven secondary backing, both of which are heavier than woven polypropylene backing typically used in the industry. In general, nonwoven backings lack the strength and dimensional stability of woven backings, and thus it would be expected that the carpet would find only limited application.

A further approach to possibly solving the problems faced by the carpet industry has been proposed by a Danish machinery builder, Campen A/S, in cooperation with a German company, Knobel GmbH. Campen/Knobel propose the use of a scattering system in which thermoplastic polymers in powder form, such as ethylene-vinyl acetate (EVA), polyethylene and polypropylene, are applied to the backside of a tufted primary carpetbacking. The backing with the powder deposited upon it is then passed through an infra-red tunnel to melt the powders, and presumably lock in the tufts.

Campen/Knobel do state, however, that if special fiber lock is required, then a traditional filled pre-coat can be applied. In point of fact, Applicants believe that the scatter coating approach, in commercial practice, always or nearly always involves the use of a latex pre-coat. Moreover, the Campen/Knobel approach requires the purchase of new equipment by the carpet manufacturer, and will obsolete existing equipment typically found in the carpet mill. Moreover, powder coatings tend to be expensive, and for this and additional reasons based on economics as well as perhaps performance, the scattering technology (or powder coating technology) has been slow to make significant inroads into commercial carpetmaking operations except in automotive carpet in Europe.

Applicants invention solves the problems of the carpet industry which have eluded the prior art approaches.

SUMMARY OF THE INVENTION

The invention provides a tufted carpet comprising loop pile face yarns, at least one backing fabric, and an adhesive binder substantially free of inorganic and latex materials, the loop pile face yarns having a tuft bind of at least 4 pounds and a fuzz resistance rating of 1 or better. In another embodiment, the invention provides a tufted carpet comprising cut pile face yarns, at least one backing fabric, and an adhesive binder substantially free of inorganic and latex materials wherein the adhesive binder is provided in the form of an adhesive fabric, and the cut pile face yarns have a tuft bind of at least 3 and preferably at least 4 pounds. In yet another embodiment, the invention provides an improved carpet backing comprising a supporting fabric operatively connected to an adhesive fabric. In yet another embodiment, the invention provides a process for making tufted carpet comprising: tufting a primary backing fabric with face yarn; contacting the tufted primary backing fabric with an adhesive fabric; melting the adhesive fabric; and applying force to the melted adhesive fabric while in contact with the tufted primary backing.

DESCRIPTION OF THE INVENTION

Briefly, there are three aspects to the present invention. One aspect of the present invention is a new tufted carpet comprising face yarns, at least one backing fabric (i.e., at least a primary backing fabric), and an adhesive binder (preferably provided in fabric form) which is substantially free of inorganic and latex materials such as those which are found in the traditional binder compositions used in the prior art. Further, the new tufted carpet provides a tuft bind of at least 3 and preferably at least 4 pounds in cut pile construction, and at least 4 pounds in loop pile construction, which are generally accepted as industry minimum standards. The minimums required to satisfy FHA housing guidelines were previously 4 pounds but recently were lowered to 3 pounds for cut pile construction, but are 6.25 pounds for loop pile construction. This higher standard for loop pile construction is also achieved and surpassed by the present invention. In loop pile construction, the inventive carpet has a fuzz rating (as more fully explained below) of 1 or 0. Another aspect of the invention relates to new improved carpet backing which comprises a supporting fabric that is operatively connected (i.e., attached) to an adhesive fabric. The backing may be either a primary or secondary carpet backing. In the case where the backing is intended to be used as a primary backing, the adhesive fabric is preferably disposed on the stitched surface (i.e., the non-pile side) of the tufted primary backing between the tuft stitches and the woven supporting fabric. In the case of a secondary backing, it is intended that the adhesive fabric be juxtaposed with the tufted primary backing so as to contact the stitched surface of the primary backing. A third aspect of the present invention is a new process for making tufted carpet comprising the steps of tufting a primary backing fabric with face yarn, contacting a tufted primary backing fabric (which optionally may have, but is not required to have, an adhesive fabric operatively connected to the non-pile side of the backing prior to tufting) with an adhesive fabric, melting the adhesive fabric, and then applying force to the melted adhesive fabric while in contact with the tufted primary backing. Alternatively, the process may also be conducted by reversing the first and second steps so that the primary backing fabric is first contacted with an adhesive fabric and then the combined primary backing and adhesive fabric are tufted; aditional adhesive fabric is preferably then contacted with the tufted composite prior to the melting step.

More particularly, with respect to the new tufted carpet of the present invention, it is preferred that the adhesive binder comprise at least one thermoplastic resin. Because the vast majority of tufted carpets are made with thermoplastic face yarns and thermoplastic primary and secondary backings, the use of a thermoplastic adhesive binder significantly promotes the recyclability of the used carpet as well as the recyclability of mill scrap. In actual practice, the thermoplastic used as the adhesive binder may be selected from a wide range of materials, so long as the thermoplastic has a melting point which is at least about 20° C. lower than the melting point of the thermoplastic used in the primary and secondary backings of the tufted carpet, and so long as it is not too viscous at processing temperatures that it does not flow around the tufts and provide bonding. For example, when the primary backing is, as is frequently the case, made from crystalline propylene homopolymer with a typical melting point as determined by differential scanning colorimetry (DSC) of about 165° C., the adhesive binder may be linear low density polyethylene, which has a melting point about 40° C. lower than propylene homopolymer. Other suitable resins include propylene random copolymers, metallocene polymers, syndiotactic polypropylene, low melting polyamides, polyesters, ethylene copolymers (including, for example, ethylene-vinyl acetate and ethylene methyl acrylate copolymers), low density polyethylene, and high density polyethylene. At present, Applicants prefer linear low density polyethylene because of its melting characteristics and the performance properties such as tuft bind and fuzz resistance which it imparts to the final carpet product, and also because of its relatively low cost. Two particularly linear low density polyethylene which are preferred by Applicants are provided by the Dow Chemical Company and are sold under its trademarks Aspun 6806 and Aspun 6831.

Other preferred resins include blends of linear low density polyethylenes such as Aspun 6806 and metallocene polyethylene, and blends of linear low density polyethylenes with low density polyetehylenes, such as Rexene 2080 provided by Rexene Corporation.

Another preferred characteristic of the adhesive binder is that it have a relatively high melt index or melt flow rate in order to facilitate good wetting and encapsulation of the tufts. In the case of linear low density polyethylenes, a melt index (as determined by ASTM D-1238) above 30 grams per 10 minutes (at 190° C.) is preferred; a melt index above 60 grams per 10 minutes (at 190° C.) is most preferred.

For convenience in application and in order to maintain a consistent and uniform amount of adhesive across the entire carpet, the adhesive binder should, in accordance with one embodiment of the invention, be supplied in the form of a fabric. In such form, the adhesive binder can be supplied in weights of less than about 12 ounces per square yard, while still providing good to excellent physical properties to the final carpet. Preferably, weights below 9 ounces per square yard, and most preferably below 6 ounces per square yard are used while maintaining acceptable carpet properties.

A most preferred form of fabric for providing the adhesive binder is a nonwoven fabric. Nonwovens traditionally are lower in cost than woven fabrics, and thus are advantageously employed in the present invention especially when they are of sufficient uniformity to achieve uniform bonding (and because the strength of the adhesive fabric prior to its use in the carpet is not critical to its use so long as it can be handled). In this regard, Applicants prefer continuous filament nonwoven fabrics as disclosed in U.S. Pat. No. 5,173,356, issued on Dec. 22, 1992, to Eaton, et al. (incorporated herein by reference). The fabrics produced according to the Eaton patent have a particularly consistent and uniform basis weight. Uniformity is important because it allows the carpet manufacturer to reduce the overall weight (and cost) of the final carpet by minimizing the amount of adhesive binder that must be employed. Also, these fabrics can be used, and preferably are used, in an uncalendered condition which renders them more readily meltable. Examples of such fabrics are those sold by Amoco Fabrics and Fibers Company as RFX® fabric.

Another particularly advantageous feature of the fabrics produced in accordance withthe Eaton et al. patent is that they can be handled "as is" without the need for any further mechanical consolidation, chemical binders, or thermal calendering. Accordingly, because such additional operations are eliminated, these fabrics can be economically produced on a basis-which allows the present invention to be cost competitive with the traditional latex approach to carpet manufacture. It is to be understood, however, that while self-bonded fabrics are preferred, the adhesive fabric may also be supplied in any convenient form, as, for example, a spunbond, meltblown, or needlepunched nonwoven fabric, the latter being made from staple fibers, continuous filaments or both. Spunbond fabrics and their manufacture are described, for example, in U.S. Pat. No. 3,502,763, issued Mar. 24, 1970 to Carl Freudenberg Kommanditgesellschaft Auf Actien; meltblown fabrics are described in, for example, U.S. Pat. No. 3,972,759, issued Aug. 3, 1976 to Exxon Corporation.

If tufted carpet is to be constructed from dissimilar thermoplastics, for example, nylon face yarns and polypropylene primary and secondary backings, it may be desirable for purposes of aiding the recyclability of the used carpet and any mill scrap that is generated to include in the adhesive binder composition a compatibilizing agent for the different resins. Alternatively, the compatibilizer can be included in any of the component parts of the carpet, maybe added separately during the manufacture of the carpet, as, for example, by application to a backing fabric before or after tufting by use of a roller or by spraying, or may be added separately during recycling operations. Compatibilizers can also serve to reduce the overall viscosity of the thermoplastic adhesive and increase the wetting of the face yarns by the adhesive, but any agent which does not interfere with the melting of the adhesive binder or the flow of the adhesive binder in the molten state into the tufts of the carpet is acceptable. Applicants have found functionalized polyolefin compatibilizers to be satisfactory for use with polypropylene backings and nylon face yarns. One such compatibilizer is a maleated random-polypropylene copolymer having a melt flow rate of 850 at 230° C., sold as Fusabond MZ-278D by E. I. DuPont de Nemours & Company. Also suitable is a maleated polyethylene wax sold by Eastman Chemicals, Inc. as "C-18", or ethylene-acrylic acid copolymers containing 3 to 20 percent acrylic acid, available from Exxon Chemicals.

Another aspect of the present invention relates to improved carpet backings. More particularly, the carpet backings can comprise a traditional primary or secondary backing fabric, (either woven or nonwoven although a woven fabric is preferred because of its higher strength to weight ratio and because it aids in creating fuzz resistant carpets), to which an adhesive fabric of the type referred to above has been operatively connected, for example, by point bonding, thermal calendering, or needling (or any other method known to those in the art). The traditional primary and secondary backings form supporting fabrics which can be used in the standard carpet mill operation to carry the adhesive fabric through the tufting, washing, dyeing, and drying operations (in the case of a primary carpetbacking). Such supporting fabrics are well known in the art and may include, for example, fabrics made from splittable yarns as disclosed in U.S. Pat. No. 3,359,934, issued Dec. 26, 1967 to Schwartz et al. In the case of a secondary backing material, the supporting fabric can be used to carry the adhesive fabric to the tufted primary backing using apparatus traditionally associated with the application of latex. The secondary backing, with the adhesive fabric, can then be mated using such equipment to the tufted primary backing (which may, in accordance with an aspect of this invention, optionally also have an adhesive fabric) immediately prior to transport of the composite structure through the traditional latex drying oven.

In the case where both the primary and the secondary backings are provided with adhesive fabric, any weight of adhesive fabric may be used which is effective to provide the necessary tuft bind and other performance properties required by the carpet so long as the total weight of the adhesive fabric does not become so great as to interfere with the manufacture of the carpet. Generally, it is preferred that the total weight of the adhesive fabrics be equal to or less than about 12 ounces per square yard to minimize weight and expense. More preferably, the total weight of the adhesive fabric is 9 ounces or less to further reduce costs and to enhance processing speeds. Total weights below even 6 ounces per square yard have also been demonstrated to result in carpet having good tuft bind and other good performance characteristics. It will be appreciated by those having the benefit of this disclosure, however, that while certain performance and property advantages may be obtained by providing some of the adhesive as an adhesive fabric in each of the primary and secondary fabrics, that for reasons of improving operations or simplicity in the manufacturing process, it is not essential that the adhesive fabric be found in both the secondary and primary backings or, indeed, that the same adhesive fabric be used in both backings. For example, depending on the application and carpet properties desired, a low viscosity adhesive may be used to make the adhesive fabric of the primary backing to improve fuzz resistance and a different viscosity, higher strength adhesive may be used to improve tuft bind. Whenever a secondary backing is used, however, Applicants prefer to use at least some adhesive fabric on the secondary backing at a weight of at least about 1.5 ounces per square yard to provide good delamination strength and dimensional stability to the carpet. Furthermore, the preferred adhesive fabric weight will depend on factors such as the face yarn type (e.g., nylon or polypropylene), its denier, and the stitch pattern in the primary backing.

A preferred woven supporting fabric for primary backing uses is a polyolefin fabric woven from yarns of substantially rectangular cross-section, e.g., slit film yarns, in square or rectangular weave, to form a flat fabric of essentially uniform thickness. The uniform thickness of the backing and substantially rectangular cross-section of the backing yarns facilitates tufting of the backing because friction during needle penetration is reduced and arcuate yarn surfaces capable of deflecting the tufting needles are absent. One such backing having yarns of substantially rectangular cross-section in a one-to-one weave is disclosed in U.S. Pat. No. 3,110,905 issued Nov. 19, 1963, to Rhodes, which is incorporated herein by reference. Most preferably, fabrics woven from yarns of polypropylene, polyester, or a blend of polypropylene and polyester, having a substantially rectangular cross-section are used.

A preferred supporting fabric when the backing is to be used as a secondary backing is a woven backing having yarns of substantially rectangular cross-section in the warp and weft, or in the warp with spun weft yarns. Woven backings of the latter construction have advantageously been used as secondary backings when a latex binder has been employed due to the added ability of the spun yarns to interact with the latex, notwithstanding the added complexity and cost of manufacturing a fabric from two different types of yarn. In the case of the present invention, however, because latex has been supplanted in the manufacturing process by use of an adhesive fabric, the need for secondary backings having spun yarns has been reduced, providing yet an additional advantage to the carpet manufacturer.

Again, polypropylene, polyester, or a blend of polypropylene and polyester are the preferred materials for use in the manufacture of the supporting fabric. Secondary backing characteristics also vary with carpet style as is known, but for purposes of the present invention a secondary backing having a more open weave, is preferred because it aids in heat transfer during the melting and cooling of the adhesive fabric. The supporting fabric, as well as the adhesive fabric, may have special characteristics imparted to either or both of them by incorporation or application of various dyes, additives, modifiers, or surface treatments to improve resistance to flame or stains, reduce static charge, impart color, and for other purposes. It is to be understood, however, that the use of such additional materials, in typical proportions, are within the scope and spirit of the present invention. Thus, when we refer to adhesive binders or adhesive fabrics which are "substantially free of inorganic and latex materials," we do not intend to exclude from the scope of the invention adhesives to which such additives have been incorporated.

According to the process of this invention, a carpet can be made by tufting a primary backing fabric with face yarn (preferably a thermoplastic face yarn), followed by contacting the tufted primary backing fabric with an adhesive fabric, which need not necessarily be attached to either the primary or the secondary backings prior to contact with the tufted primary, melting the adhesive fabric, and pressing the adhesive fabric while melted into the tufted primary backing. Alternatively, the primary backing fabric may first be contacted with the adhesive fabric and then the combined primary backing and adhesive fabric are tufted. It will readily be appreciated by those skilled in the art that in the context of the traditional latex method for manufacturing carpets, the adhesive fabric can conveniently be supplied for contact with the tufted primary backing at the same time the secondary backing is being provided. Thus, the same "marrying" roll used to combine the secondary with the tufted primary can also be used to contact the tufted primary backing with the adhesive fabric, as well as with the secondary backing if one isto be employed.

The composite carpet structure can then be conveniently heated to melt the adhesive fabric by any of several conventional techniques. For example, the composited structure can be fed over a hot drum laminator which comprises a heated drum, followed by the application of pressure to the composited structure through use of a pressure roll assembly. Typically, the backings contact the drum such that the secondary backing is in contact with the drum thereby avoiding potential damage to face yarns due to prolonged contact with the heated surface of the drum. Conventional drying ovens of the type used in the latex processes can also be used, the contacted backings and adhesive fabric being passed therethrough with a revolving tenter frame or over rolls or other similar means. Following exit from the latex oven, the secondary and tufted primary backings can be pressed into the melted adhesive fabric, again through the use of pressure rolls. As will be understood by those familiar with this art having the benefit of this disclosure, it is advantageous to press the melted adhesive fabric while the adhesive is in the molten state because this aids in achieving good tuft bind and especially good fuzz resistance in the final carpet product. Cooling of the carpet structure can be accomplished by any suitable means, for example, by simply passing the carpet structure into an ambient temperature zone, or preferably into a cooling box or against chill rolls to lock the configuration into place. When line speeds, for example in excess of 40 feet/minute are desired, then the use of such a cooling box or chill rolls is recommended. A tenter to minimize and control shrinkage during these steps is also desirable. Applicants believe that line speeds of carpet made with the meltable adhesives of this invention can be at least as high as those of carpets made with filled latex adhesives in conventional forced air ovens.

It will be appreciated that an essential aspect of the present invention is the use and application of force to aid in pressing the molten adhesive into the tufted primary and, when a secondary is used; to fuse the secondary backing to the carpet. While the precise lower and upper limits of the pressure to be applied will depend on numerous factors, such as the nature and material used for the face yarn (nylon generally being more resilient that polypropylene, for example), the viscosity of the adhesive composition used in the adhesive fabric, the temperature of the ovens, the residence time in the ovens, and the weight of the adhesive fabric, Applicants have found that a higher force is generally better than a low force so long as crushing of the face yarns is minimized. Generally a minimum force of roughly 10 pounds per lineal inch is required for cut pile carpets, while a minimum of 20 pounds, preferably 40 pounds and most preferably 80 pounds per lineal inch, is required to produce loop pile carpets having acceptable tuft bind and fuzz resistance properties. In general, it is more difficult to achieve both high tuft bind and good fuzz resistance rather than simply high tuft bind alone, and in loop pile carpets fuzz resistance is a critical property required to maintain good carpet appearance. Thus, in general higher forces are used in this invention in the construction of loop pile carpets than in cut pile carpets. It has also been found that, again in general, pressures in excess of 300 pounds per lineal inch result in matting and crushing of the face yarns and therefore are to be avoided.

The following examples are intended to illustrate the invention but should not be viewed as limiting the scope thereof.

EXAMPLES

A series of tufted carpets was manufactured using various thermoplastic adhesives primarily in fabric form. For each of the following examples, the materials used, the manufacturing equipment, the manufacturing procedures, and test methods, are all as indicated below unless for a specific example an exception is noted.

Tufted Primary Backing Materials: Thirteen styles of tufted primary backings were used and are identified as NY-1 to NY-10, PP-1 and PP-2 and PET-1. The tufted primary backings were made according to the following specifications, it being understood that in examples which employ an adhesive fabric under the primary backing that the primary backing was tufted with the adhesive fabric disposed on the stitched surface of the backing between the woven polypropylene supporting fabric and the tufts. The supporting fabric carpet backings, PolyBac® and FLW®, are each available from Amoco Fabrics and Fibers Company of Atlanta, Ga.

| | |
|---|---|
| NY-1 | Nylon 6 face yarns; loop pile construction, ⅛ gauge, straight stitch, tufted on PolyBac Style 2205 woven polypropylene backing. Yarn style: bulked continuous filament; denier: 2750. Pile height: 0.25 inch; pile weight 17.8 ounces/sq yd. (osy). |
| NY-2 | Nylon 6 face yarns; loop pile construction, ⅛ gauge, straight stitch; tufted on FLW Style 4005 woven polypropylene carpet backing having a 1.5 osy fleece layer of a 50/50 blend of polypropylene and nylon 6 staple fiber on the pile side of the supporting fabric. Yarn style: bulked continuous filament; denier 2750. Pile height: 0.25 inch; pile weight: 17.8 osy. |

-continued

| | |
|---|---|
| NY-3 | Nylon 6 face yarns; cut pile construction, ⅜ gauge; tufted on FLW Style 4005 woven polypropylene carpet backing. Yarn style: 1100/2 cabled, heat set yarn 4 turns per inch. Pile height ½ inch; pile weight: 7 osy. |
| NY-4 | Nylon 6,6 face yarns; cut pile construction, ⅜ gauge; tufted on a woven polypropylene carpet backing, FLW Style 4005. Yarn style: 1100/2 cabled, heat set yarn 4 turns per inch. Pile height: ½ inch; pile weight: 12 osy. |
| NY-5 | Nylon 6,6 face yarns; cut pile construction, ¼ gauge with a stepover stitch; tufted on a woven polypropylene carpet backing, FLW Style 4005. Yarn style: 1100/2 cabled, heat set yarn 4 turns per inch. Pile height: ½ inch; pile weight: 20 osy. |
| NY-6 | Nylon 6,6 face yarns; cut pile construction, ⅛ gauge, straight stitch, tufted on a woven polypropylene backing, PolyBac Style 2205. Yarn style: 1100/2 cabled, heat set yarn 4 turns per inch. Pile height: ⅝ inch; pile weight: 50 osy. |
| NY-7 | Nylon 6,6 face yarn, cut pile construction, 5/32 gauge with a straight stitch, tufted on PolyBac Style woven polypropylene carpet backing. Yarn style: spun yarn from staple fiber; 3.0/2 (cotton count/ply); cabled and heat set; 5.5 turns per inch. Pile height: ½ inch; pile weight: 24 osy. |
| NY-8 | Nylon 6 face yarn, cut pile construction, 5/32 gauge with a stepover stitch tufted on PolyBac Style 22-5 woven polypropylene carpet backing. Yarn style: bulked continuous filament, cabled, stuffer-boxed and heat set; 4 turns per inch; denier: 1400/2. Pile height: ⅝ inch; pile weight: 38 osy. |
| NY-9 | Nylon 6 face yarn, loop pile construction, 1/10 gauge with a straight stitch, tufted on PolyBac Style 2205 woven polypropylene carpet backing. Yarn style: bulked continuous filament; 2800 denier. Pile height: 0.18 inch; pile weight: 24 osy. |
| NY-10 | Nylon 6 face yarn, loop pile construction, 1/10 gauge with a straight stitch, tufted on PolyBac Style 2205 woven polypropylene carpet backing. Yarn style: bulked continuous filament; 2800 denier. Pile height: 0.18 inch; pile weight: 24 osy. |
| PP-1 | Polypropylene face yarns; loop pile construction, 1/10 gauge, tufted on a woven polypropylene carpet backing, PolyBac Style 2205. Yarn denier: 3500. Pile height: 0.25 inches; pile weight: 25 osy. |
| PP-2 | Polypropylene face yarn; loop pile construction, ⅛ gauge with a straight stitch, tufted on PolyBac Style 2205 woven polypropylene backing. Yarn style: bulked continuous filament; yarn denier 2750. Pile height: 0.24 inch; pile weight: 11.3 osy. |
| PET-1 | Polyester face yarn, cut pile construction, ⅛ gauge with a stepover stitch, tufted on PolyBac 2205 woven polypropylene backing. Yarn style: spun yarn from staple fiber; 3.8/2 (cotton count/ply); 5.5 turns per inch; cabled, stuffer-boxed, and heat set. Pile height: ½ inch, pile weight: 40 osy. |

Adhesive Fabric Materials: The adhesive fabrics used in the following examples were made following the teachings of U.S. Pat. No, 5,173,356 with the polymers identified below. The adhesive fabrics each had weights between 0.5 and 1.5 osy per ply:

| | |
|---|---|
| 6806 | Linear low density polyethylene (LLDPE), sold as Aspun 6806 by Dow Chemical Co. |
| 6831 | LLDPE, sold as Aspun 6831 by Dow Chemical Co. |
| 2220 | Ethylene methyl acrylate copolymer resin, sold as Chevron SP 2220, available from Chevron Chemical Co. |
| 2080 | Low density polyethylene, sold as Rexene 2080 by Rexene Corporation, Dallas TX. |
| Blend 1 | 90/10 mixture by weight, of 6806/maleated random-polypropylene copolymer sold as Fusabond MZ-278D by E. I. DuPont. |
| Blend 2 | 90/10 mixture, by weight, of 6806/maleated polyethylene wax ("C-18" resin from Eastman Chemicals). |
| Blend 3 | 80/20 mixture, by weight, of 6806/C-18 |

Adhesive Fiber Materials:

| | |
|---|---|
| K115 | A low melting polyamide staple fiber obtained from EMS Grilon, Inc., Sumter, SC. Staple length: 80 mm; denier: 11; melting temperature: 115° C. |
| 2080-S | A staple fiber spun from Rexene 2080, a low density polyethylene resin supplied by Rexene Corporation, Dallas, TX. Staple length: 4.5 inches; denier: 6. The melt index of Rexene 2080 resin was 100 g/10 min at 190° C. |
| 6811A | A staple fiber spun from Aspun 6811A, a linear low density polyethylene resin supplied by Dow Chemical. Staple length: 4.5 inches; denier: 6. The melt index of Aspun 6811A was 35 g/10 min at 190° C. |

Secondary Backing Supporting Fabrics:

| | |
|---|---|
| 3870 | Woven polypropylene fabric from Amoco Fabrics and Fibers Co., Atlanta, GA having a 16 × 5 pick count, a nominal weight of 2.1 osy, rectangular cross section tapes as warp yarns, and 1800 denier spun yarns as fill yarns. Color: natural. |
| 3865 | A woven polypropylene fabric identical to 3870 except that the color was light jute instead of natural. |
| R-921 | A woven polypropylene leno weave fabric having a 16 × 15 pick count, a nominal weight of 1.6 osy, 450 denier rectangular cross section tapes as warp yarns, and 1050 denier serrated tapes as fill yarns. |

Equipment: The equipment used in Examples 1–15 and 23 was the oven and calender described below:

Oven—HIX Corporation (Pittsburgh, Kans.) moving belt infra-red oven, Model 4819

Calender—Laboratory Hot Melt Calender, Type 500, with two oil-heated rolls, manufactured by Ernst Benz AG, Rumlang, Switzerland Examples 16–22 were made using the carpet laminator described below:

Carpet Laminator—1.2 meter wide laboratory carpet laminator made by Villars AG in Muenchwilen, Switzerland with letoff stand, a 2.3 meter heating zone with infrared heaters, a calender, and a takeup roll. The laminator had a moving metal belt for transporting the carpet through the heating zone.

Test Procedures:

Tuft bind was determined in accordance with ASTM D 1335.

Fuzzing was determined using the "Velcro" roller test, a common (though not universal standard) test employed by the carpet industry. More specifically, a 3-inch wide by 2-inch diameter cylindrical steel roller weighing two pounds is covered with Velcro® brand tape (the hook portion), available from Velcro USA, Inc. of Manchester, N.H. Fuzzing was determined by passing the roller 20 times (10 in each direction) over a section of loop pile carpet. The fuzzing of the carpet was then observed and graded according to the following fuzz resistance rating scale:

0 (none)—No fuzzing 1 (very low)—Slight fuzzing 2 (low)—Moderate fuzzing 3 (medium)—Considerable fuzzing 4 (high)—Severe fuzzing Carpets displaying no or slight fuzzing (0 to 1), were judged acceptable. See U.S. Pat. No. 3,684,600, Col. 4, II. 71–75 for a similar ranking scale.

EXAMPLE 1

A 12-inch wide by 18-long wide piece of tufted primary backing (NY-1) was placed pile side down on a metal belt outside the infra-red oven. The tufted primary backing had 3 osy of 6806 nonwoven adhesive fabric between the underside of the backing and the tufts. A batt of 6806 nonwoven fabric (6 osy) was placed on top of the tufted primary backing, followed by a piece of ActionBac Style 3870 secondary backing. A 2 foot by 2 foot piece of hardware cloth weighted down by two wooden boards (about 2 feet×2 inches×4 inches) was placed on top of the assembly.

The oven temperature dial was set at 300° F. To begin the lamination process, the assembly was rapidly moved into the heated section of the oven. It remained there for 3.5 minutes, during which time the adhesive fabric melted. A temperature strip on the back side of the sample indicated a surface temperature of 289° F. At the end of that period, the assembly was moved rapidly out of the oven. The hardware cloth was then quickly removed, and the assembly was passed through the heated calender at 10 ft/min. The rolls were heated to 100° C. The force applied by the rolls to the sample was 138 pounds per lineal inch. The warm consolidated carpet sample was passed a second time through the heated rolls, and then cooled under a heavy flat sheet. When cool, the sample was subjected to the Velcro roller test. No fuzzing was detected. The sample was also tested for tuft bind. Its tuft bind was 9.5 lbs.

EXAMPLES 2 through 18

These examples were carried out in the same manner as Example 1 except that the tufted primary backing, heating time, and type, amount and placement of the adhesive material were varied, as indicated on Table I. All samples had tuft binds of 6 pounds or higher and fuzz ratings of "very low" or "none," as also summarized in Table I. In Examples 9–11, the K115 staple fiber was needled into the primary backing using a Dilo cross lapper and needle loom. When K115 fiber was placed between the tufted primary and secondary backing (Examples 10–11), it was sprinkled by hand and rearranged until a uniform distribution was obtained.

In Examples 17–18 the adhesive fiber material, 2080-S and 6811A respectively, was first formed into a nonwoven fabric by carding and needling. The resulting needlepunched nonwoven adhesive fabric, at the basis weights indicated in Table I, was then attached to an untufted primary backing and then tufted to a secondary backing supporting fabric. The nonwoven adhesive fabric was also attached by needling. Carpet samples were made by placing the composite secondary fabric atop the tufted primary with the adhesive fabrics of each in facing relationship. The general procedures for heating and applying nip force described in Example 1 were employed using the conditions set forth in Table I.

COMPARATIVE EXAMPLES A AND B

Example A: A 12-inch wide by 18-inch long piece of carpet was made with tufted primary backing NY-1, 6806 nonwoven fabric adhesive, and ActionBac Style 3870 secondary backing in the same manner as in Example 1, except that the nip force applied to the hot assembly was less than 10 lbs per lineal inch. The cooled sample had a tuft bind of 9.7 lbs, but the fuzz rating in the Velcro roller test was "medium". This experiment showed that the application of pressure to the carpet assembly with molten adhesive was essential for obtaining an acceptable level of fuzz resistance.

Example B: A 12-inch wide by 18-inch long carpet sample was made in the same manner as Example 3, except that the nip force was less than 10 pounds per lineal inch. The cooled sample was tested for tuft bind and fuzz resistance. The tuft bind was 4.7 lbs and the fuzz rating was "high".

TABLE I

| | | Adhesive Amount | | Adhesive Type | | | | | |
|---|---|---|---|---|---|---|---|---|---|
| Example No. | Tufted Primary | Under Primary (osy) | On Secondary (osy) | Under Primary (osy) | On Secondary (osy) | Heating Time (min) | Calender Force (pli) | Tuft Bind (lb) | Fuzz Rating |
| A | NY-1 | 3 | 6 | 6806 | 6806 | 3.5 | <10 | 9.7 | medium |
| 1 | NY-1 | 3 | 6 | 6806 | 6806 | 3.5 | 138 | 9.5 | none |
| 2 | NY-1 | 0 | 11 | — | 6806 | 4 | 275 | 8.3 | v. low |
| B | NY-1 | 6 | 3 | 6806 | 6806 | 3.5 | <10 | 4.7 | high |
| 3 | NY-1 | 6 | 3 | 6806 | 6806 | 3.5 | 92 | 9.1 | none |
| 4 | NY-1 | 3 | 6 | 6806 | Blend 1 | 3 | 229 | 7.4 | v. low |
| 5 | NY-1 | 3 | 6 | 6806 | Blend 1 | 3.5 | 229 | 7.4 | none |
| 6 | NY-1 | 3 | 6 | 6806 | Blend 1 | 4 | 229 | 8.0 | none |
| 7 | NY-1 | 3 | 8 | 6806 | Blend 2 | 4 | 275 | 9.8 | none |
| 8 | NY-1 | 3 | 6 | 6806 | Blend 3 | 3.5 | 229 | 8.7 | none |
| 9 | NY-1 | 3 | 6 | K115 | 6806 | 3.5 | 229 | 7.9 | none |
| 10 | NY-1 | 5 | 3 | K115 | K115 | 3.5 | 229 | 17.0 | v. low |
| 11 | NY-1 | 3 | 6 | K115 | K115 | 3.5 | 229 | 9.0 | v. low |
| 12 | PP-1 | 0 | 9 | — | 6806 | 3.5 | 138 | 7.7 | v. low |
| 13 | NY-1 | 3 | 3 | 6806 | 6806 | 3.0 | 138 | 8.3 | v. low |
| 14 | NY-1 | 3 | 6 | 2080 | 6806 | 3.5 | 183 | 8.6 | none |
| 15 | NY-1 | 3 | 6 | 2220 | 6806 | 3.5 | 183 | 8.5 | v. low |
| 16 | PP-2 | 1.5 | 4.5 | 6806 | 6806 | 3.0* | 25 | 12.2 | v. low |
| 17 | NY-1 | 3 | 6 | 2080-S | 2080-S | 3.5 | 92 | 7.5 | v. low |
| 18 | NY-1 | 3 | 6 | 6811A | 6811A | 3.75 | 92 | 11.2 | v. low |

*Oven temperature set at 280° F.

EXAMPLES 19–21

A 30-inch wide band of face yarn was tufted through a woven primary backing having 3 osy of a nonwoven adhesive fabric made from 6831 resin needlepunched to the stitched (i.e., non-pile side) surface of the backing. A 36-inch wide web of 6 osy of 6831 nonwoven adhesive fabric attached to ActionBac 3870 secondary backing was lightly needled to the underside of the tufted primary backing. The entire assembly was wound on a roll and positioned on the letoff of the Villars carpet laminator. The assembly was passed pile side down through the laminator at a speed of 0.5 meters/min. The adhesive fabric melted as it passed under the heaters. The surface temperature of the back side of the carpet after it had passed through 2 meters of heaters was 128° C. As soon as the carpet exited the heater zones, it passed through a calendar, where a nip force of 59 pounds per lineal inch was applied to consolidate the entire assembly. The carpet then passed over a chill roll and was wound up on a roll. A section of the finished carpet was removed to test for tuft bind and fuzz resistance. The tuft bind was 10.9 lbs and the fuzz rating was "very low."

Examples 20–21 were made in accordance with the general procedure of Example 19, except for the variances indicated on Table II. These examples also illustrate construction of loop pile carpets in accordance with the present invention.

TABLE II

| Example No. | Tufted Primary | Backside Surface Temperature (° C.) | Line Speed (m/min) | Adhesive Fabrics | Calender Nip Force (pli) | Tuft Bind (lb) | Fuzz Rating |
|---|---|---|---|---|---|---|---|
| 19 | NY-1 | 128 | 0.5 | 3 osy 6831 under primary and 6 osy of 6831 on secondary | 59 | 10.9 | very low |
| 20 | NY-1 | 121 | 0.6 | 3 osy of 2080 under primary and 6 osy of 6806 on secondary | 59 | 8.5 | very low |
| 21 | NY-2 | 126 | 0.5 | 3 osy of 6806 under primary and 6 osy of 6831 on secondary | 59 | 12.0 | very low |

EXAMPLES 22–25

A composite of a 40-inch wide roll of tufted primary backing NY-3, 4 osy of a nonwoven web of 6831 nonwoven adhesive fabric, and ActionBac® 3870 was lightly needled together and wound on a roll. The assembly was placed on the letoff of the Vilars laminator, and then feed through the laminator at a speed of 0.9 meters/min. The heaters were adjusted so that the backside surface temperature of the assembly was 126° C. at the end of the second heating zone. A calendar nip force of 45 pounds per lineal inch was applied to the assembly. It was then cooled and taken up on a roll. The tuft bind strength was measured on the finished carpet. The tuft bind strength was 4.3 lbs.

Examples 23–25 were made following the general procedure of Example 22, except for the variances noted in Table III.

TABLE III

| Example No. | Tufted Primary | Backside Surface Temperature (° C.) | Line Speed (m/min) | Adhesive Fabric attached to Secondary | Calender Nip Force (pli) | Tuft Bind (lb) |
|---|---|---|---|---|---|---|
| 22 | NY-2 | 126 | 0.9 | 4 osy 6831 | 45 | 4.3 |
| 23 | NY-4 | 128 | 0.9 | 6 osy 6806 | 44 | 4.9 |
| 24 | NY-6 | 133 | 0.7 | 6 osy 6806 | 44 | 5.3 |
| 25 | NY-6 | 130 (est) | 0.7 | 8 osy 6806 | 44 | 7.1 |

EXAMPLE 26–29

In Example 26 a 12-inch by 18-inch piece of tufted primary backing NY-5 was placed pile side down on the belt of the infrared oven. A layer of 6 osy of 6806 nonwoven adhesive fabric was placed on top, followed by a layer of ActionBac® Style 3870 secondary backing. The assembly was covered with a piece of hardware cloth, and then placed inside the oven, where it was heated for three minutes at a dial setting of 300° F. During that time the fabric adhesive melted and the backside temperature of the assembly reached about 289° F. The hot assembly was removed from the oven and immediately passed through a calender at a speed of 10 ft/min while applying a nip force of 92 pil. After a second pass through the calender, the carpet was allowed to cool between two flat surfaces. The tuft bind of the sample was 4.3 lbs.

Examples 27–29 were made in accordance with the general procedure of Example 26, except for the variances indicated on Table IV. These examples also illustrate the construction of cut pile carpet in accordance with the present invention.

EXAMPLE 30

A 152-inch wide tufted primary backing (NY-9) was contacted with a composite of 4.5 osy of 6806 nonwoven adhesive fabric attached by needling to style 3870 secondary backing supporting fabric. The combined fabrics were then put in contact with the surface of a 14-ft diameter rotating, oil-heated drum. The secondary backing supporting fabric of the carpet assembly was against the drum, and the nonwoven adhesive fabric was between the secondary backing and the back side of the tufted primary backing. The oil in the drum was preheated to 340° F., and the speed of rotation of the edge of the drum was 20 ft per minute. After the carpet assembly moved on the surface of the rotating drum for an arc of 340 degrees, it passed over a turning roll and series of infra-red heaters that maintained the back of the carpet at 260° F. until it was passed through a pair of chrome-plated steel nip rolls. The rolls applied a nip force of 22 pounds per lineal inch to the carpet. After the carpet passed through the nip rolls, it was transferred to a tenter frame, cooled, and wound up on a roll. The tuft bind was measured on the carpet. The tuft bind was 5.8 lbs on the cut pile portion, and 9.9 lbs on the loop pile portion.

EXAMPLE 31

The general procedure of Example 1 was repeated except that secondary backing R-921 was substituted for secondary backing 3870. The carpet assembly was composed of tufted primary backing NY-1 with 3 osy of 6806 nonwoven adhesive fabric attached, a 6 osy web of 6806 nonwoven adhesive fabric, and secondary backing supporting fabric R-921. The assembly was heated for 3.5 minutes at an oven temperature setting of 300° F. At the end of that period, it was immediately passed through a calender that applied a nip force of 92 pounds per lineal inch. The final carpet was tested for physical properties. Its tuft bind was 9.5 lbs, and the fuzz rating in the Velcro roller test was "very low." The delamination strength measured according to ASTM D-3676 was 10.5 lbs/inch. The strength was significantly above the FHA minimum requirement of 2.5 lbs/inch.

EXAMPLES 32 AND 33

Example 32 illustrates a process in which a freestanding nonwoven fabric is needled to the underside of the carpet prior to melting.

In Example 32, tufted primary backing NY-10 was placed pile side down on a needleloom. A 6 osy batt of 6806 nonwoven adhesive fabric was placed on top of the tufted primary backing and was needled into the back side of the pile yarns using a needle density of 1200 penetrations per inch, a needling depth of 12 mm, and a type F-20-6-22-3.5-NK/15X18X36X3RB needle manufactured by Foster Needle Co., Manitowoc, Wis. The needlepunched composite of NY-10 and the nonwoven fabric was placed pile side down on a belt in the infra-red oven of Example 1. An additional 3 osy of 6806 nonwoven adhesive fabric was placed on top of the assembly, followed by a piece of 3870 secondary backing. Following the procedure in Example 1, the entire assembly was heated for 3.75 minutes at an oven temperature setting of 300° F. and then immediately passed through calender rolls which applied a nip force of 92 pounds per lineal inch. The final carpet was tested for tuft bind and fuzz resistance. The tuft bind was 9.1 lbs, and the fuzz rating in the Velcro roller test was "very low."

In Example 33, the procedure of Example 32 was repeated except that the nonwoven adhesive fabric was not needlepunched into the back side of the pile yarns. A total of 9 osy of 6806 nonwoven adhesive fabric was used. The carpet from this experiment had a tuft bind of 7.6 lbs and a fuzz rating of "very low to none."

Both Examples 32 and 33 resulted in carpets meeting the criteria for fuzz resistance. However, the tuft bind in Example 32 was slightly higher than in Example 33.

TABLE IV

| | | Adhesive Amount | | Adhesive Type | | | | |
|---|---|---|---|---|---|---|---|---|
| Example No. | Tuft Primary | Under Primary (osy) | Under Secondary (osy) | Under Primary (osy) | Under Secondary (osy) | Heating Time (min.) | Calender Force (pli) | Tuft Bind (lb) |
| 26 | NY-5 | 0 | 6 | — | 6806 | 3.0 | 92 | 4.3 |
| 27 | NY-7 | 0 | 7.6 | — | 6806 | 3.25 | 92 | 4.3 |
| 28 | NY-8 | 1.5 | 4.5 | 6806 | 6806 | 3.5 | 75 | 5.2 |
| 29 | PET-1 | 0 | 6 | — | 6806 | 2.5 | 25 | 4.8 |

What is claimed is:

1. A secondary carpet backing consisting of a nonwoven adhesive fabric needled or thermally bonded to a supporting fabric, wherein the nonwoven adhesive fabric is a self-bonded or spunbonded nonwoven fabric comprising continuous filaments of a thermoplastic resin and the supporting fabric is an open weave secondary backing fabric comprising thermoplastic warp yarns with a substantially rectangular cross-section woven in a leno weave with thermoplastic weft yarns that are spun yarns or yarns having a substantially rectangular cross-section.

2. The secondary carpet backing of claim 1 in which the supporting fabric is woven from polypropylene yarns.

3. The secondary carpet backing of claim 2 in which the nonwoven fabric is a spunbonded fabric.

4. The secondary carpet backing of claim 2 in which the nonwoven fabric is a self-bonded fabric.

5. The secondary carpet backing according to claim 1 in which the weft yarns comprise spun yarns.

6. The secondary carpet backing of claim 5 in which the warp and weft yarns comprise polypropylene yarns.

7. The secondary carpet backing of claim 6 in which the warp and weft yarns are woven in a 16×5 count.

8. The secondary carpet backing of claim 7 in which the substantially continuous filaments comprise a thermoplastic resin having a melting point at least about 20° C. less than the melting point of the thermoplastic resin of the yarns of the supporting fabric.

9. The secondary carpet backing of claim 1 in which the substantially continuous filaments comprise a thermoplastic resin having a melting point at least about 20° C. less than the melting point of the thermoplastic resin of the yarns of the supporting fabric.

* * * * *